US006315678B1

(12) United States Patent
Teramoto

(10) Patent No.: US 6,315,678 B1
(45) **Date of Patent: *Nov. 13, 2001**

(54) GOLF CLUBS AND GOLF CLUB SETS

(75) Inventor: Seiichiro Teramoto, Fukuoka (JP)

(73) Assignee: Aneeging Sports Co., LTD (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/206,804

(22) Filed: Dec. 7, 1998

(30) Foreign Application Priority Data

Jan. 20, 1998 (JP) ..... 10-009174
Mar. 25, 1998 (JP) ..... 10-078107

(51) Int. Cl.[7] ..... A63B 53/04
(52) U.S. Cl. ..... 473/291; 473/346; 473/349
(58) Field of Search ..... 473/290, 291, 473/287, 288, 289, 345, 346, 349, 350, 324, 327, 328

(56) References Cited

U.S. PATENT DOCUMENTS

| | | | | |
|---|---|---|---|---|
| D. 385,607 | | 10/1997 | Adams . | |
| D. 405,857 | * | 2/1999 | Lovett | D21/747 |
| 1,642,462 | | 9/1927 | Reach . | |
| 4,147,349 | | 4/1979 | Jeghers . | |
| 4,754,969 | | 7/1988 | Kobayashi . | |
| 4,986,541 | | 1/1991 | Teramoto et al. . | |
| 5,046,733 | | 9/1991 | Antonious . | |
| 5,056,788 | * | 10/1991 | Katayama | 473/291 |
| 5,106,087 | | 4/1992 | Simmons et al. . | |
| 5,318,296 | | 6/1994 | Adams et al. . | |
| 5,388,826 | | 2/1995 | Sherwood . | |
| 5,433,439 | * | 7/1995 | Hsien | 473/291 |
| 5,480,152 | * | 1/1996 | Schmidt . | |
| 5,482,279 | * | 1/1996 | Antonious | 473/345 |
| 5,501,460 | * | 3/1996 | Scheie . | |
| 5,616,086 | | 4/1997 | Chappell . | |
| 5,716,292 | * | 2/1998 | Huang | 473/349 |
| 5,746,666 | * | 5/1998 | Lovett | 473/328 |
| 5,755,624 | * | 5/1998 | Helmstetter | 473/291 |
| 5,779,565 | | 7/1998 | Adams . | |
| 5,827,130 | | 10/1998 | Jimenez et al. . | |
| 5,827,132 | | 10/1998 | Bamber . | |

* cited by examiner

*Primary Examiner*—Jeanette Chapman
*Assistant Examiner*—Stephen L. Blau
(74) *Attorney, Agent, or Firm*—Baker & Daniels

(57) ABSTRACT

Golf clubs and golf club sets which include weights which control the effective loft angles of the club head. Weights positioned adjacent the top of the club heads between the face and bottom focus the mass of the club head to improve striking force or power imparted to a ball upon impact. Weights positioned adjacent the face of the club heads between the bottom and top create moments of inertia which effect the loft angle of the club faces when a ball is struck by the clubs. These two types of weight positions can be combined together.

9 Claims, 8 Drawing Sheets

#1

#5

#10

GOLF CLUBS AND GOLF CLUB SETS

TECHNICAL FIELD

The present invention relates to golf clubs and golf club sets. More particularly, the present invention is directed to golf clubs and golf club sets which are weighted in a particular manner to control backspin and striking force or power.

BACKGROUND ART

One of the profound pleasures of golfing is achieved when the ball is hit properly so that it travels in a desired direction for desired distance. The frequency of hitting a ball with such accuracy increases proportionally with one's skill level. However, a large population of golfers does not regularly achieve such accuracy and therefore, it is a very rewarding and exhilarating experience which most golfers enjoy.

Over the years, golf clubs have been improved to make it easier for golfers to hit balls more accurately. For example, a number of improvements have been developed to increase the sweet area of club heads.

In addition to hitting a ball for distance and direction, it is possible to design golf clubs which control the extent a ball will roll once it hits and lands on the ground. Generally such performance characteristics are achieved by the designs of the loft angles and striking surfaces.

Numerous clubs have been developed that have low centers of gravity, or are based on changes in the depth of the center of gravity or the like.

The present invention provides golf clubs which are designed to control backspin and striking force or power.

DISCLOSURE OF THE INVENTION

According to other features, characteristics, embodiments and alternatives of the present invention which will become apparent as the description thereof proceeds below, the present invention provides a golf club including:

- a shaft;
- a head having a mass, a face, a bottom, a top which extends between the face and the bottom, and opposed sides; and
- a weight located adjacent the top of the head between the face and the bottom thereof and positioned so as to change a focus of the mass from an unweighted focal position.

The present invention also provides a golf club including:

- a shaft;
- a head having a mass, a face, a bottom, a top which extends between the face and the bottom, and opposed sides; and
- a weight located adjacent the face of the head between the bottom and top and positioned to provide a moment of inertia which causes an effective change in a loft angle of the face at impact when a ball is struck by the club.

The present invention also provides for sets of golf clubs which include the use of weights in the faces of the clubs and/or weights in the tops of the club heads.

The present invention further provides a golf club head includes:

- a head having a face, a bottom, a top which extends between the face and the bottom, and opposed sides;
- a weight provided adjacent the top which provides a focal change in the mass of the head from an unweighted focal position; and
- another weight provided adjacent the face which provides a moment of inertia when the face strikes a ball.

BRIEF DESCRIPTION OF DRAWINGS

The present invention will be described hereafter with reference to the attached drawings which are given as non-limiting examples only, in which.

BEST MODE FOR CARRYING OUT THE INVENTION

The present invention is directed to golf clubs and golf club sets which are weighted in such a manner to control backspin and improve striking force or power imparted to a ball. The weighted clubs of the present invention can include additional weights in the club head or can otherwise be manufactured so as to concentrate a percentage of the weight of a golf club head at a predetermined location. The weighted golf clubs of the present invention include weights which are positioned in accordance with a "flow design" which is based upon progressive loft angles throughout a set of golf clubs. As used herein, the term "flow design" refers to the manner in which club design, e.g. weight position, varies in a continuous manner throughout a set of clubs such as woods or irons.

The manner of positioning or concentrating weight in a golf club or throughout a set of golf clubs according to the present invention can be applied to woods or irons. Moreover, the principals of the present invention are applicable to golf clubs which have various types of shafts, including, but not limited to, metal and graphite shafts.

The present invention is based in part upon a method of orienting the mass of a club head so as to focus the mass in a particular manner. As discussed in more detail below, the mass of a club head is "focused" so that it defines an area or volume which projects inwardly from the face of a club head. According to the present invention, weights are used to change the depth as well as the orientation of the mass of club heads. The focused area or volume of mass in a club head effects the striking force or power which is transferred to a ball upon impact. The deeper the focal point is from the center of club face where a ball is hit, the more striking force or power imparted to the ball.

Backspin affects both the distance a ball will travel in the air and the distance a ball will roll once it hits and lands on the ground. For sensitive control of distance and direction, it is required that the ball goes up high in the air with a lot of backspin. While backspin will stop a ball on the green just after landing without too much roll, too much backspin can cause a ball to decelerate in flight. Accordingly, it is important to control and limit excessive backspin.

The manner in which clubs are weighted, according to the present invention, provides golf club sets for golfers having various skill levels, in which each club has optimum characteristics. For example, according to the present invention, a less-lofted club provides long distance and stability. A more-lofted club provides accuracy that is sensitive for controlling of distance and direction. For purposes of the present invention, "less-lofted" clubs include #1–#3 woods or #1–#4 irons. "More-lofted" clubs include #7–#10 woods or #7–#10 irons.

Figure 1A:
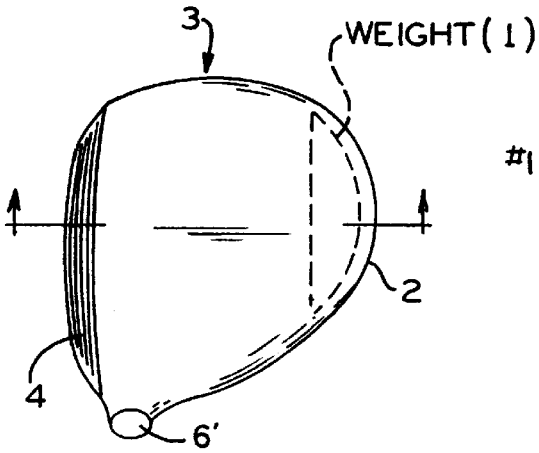
FIGS. 1*a*–1*f* depict the flow design of weight positioning for a set of golf clubs in perspective top and corresponding cross-sectional views according to one embodiment of the present invention.
Figure 1D:
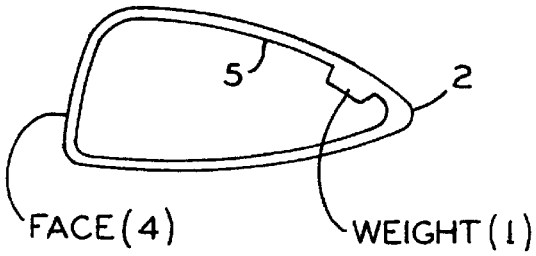
Figure 1B:
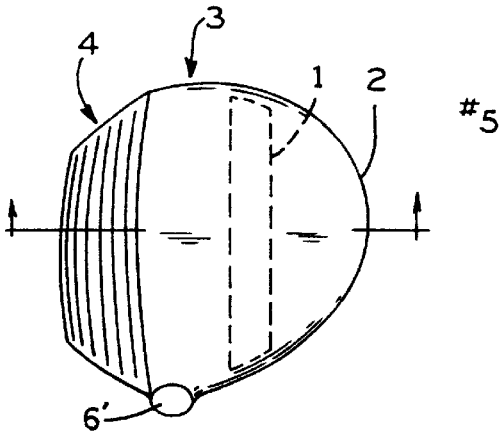
Figure 1E:
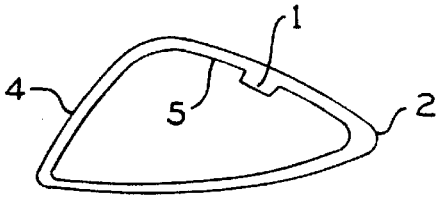
Figure 1C:
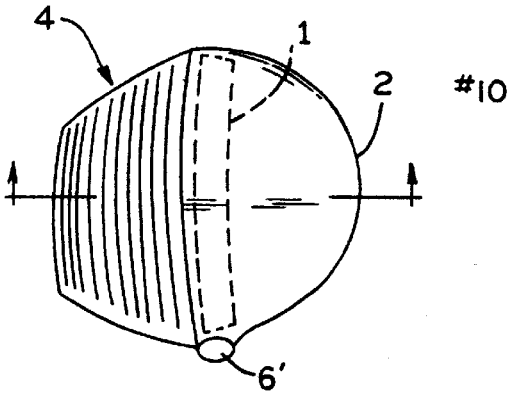
Figure 1F:
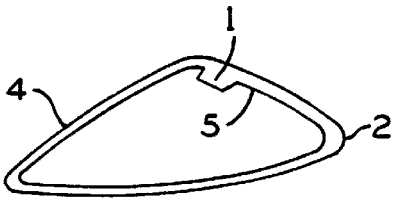

FIGS. 1*a*–1*f* depict the flow design of weight positioning for a set of golf clubs in perspective top and corresponding cross-sectional views. FIGS. 1*a* and 1*d* correspond to a #1 wood and depict how the weight 1 is positioned near the back 2 of the club head 3. FIGS. 1*b* and 1*e* correspond to a #5 wood and depict how the weight 1 is positioned near the middle of the club head 3. FIGS. 1*c* and 1*f* correspond to a #10 wood and depict how the weight 1 is positioned near the front 4 of the club head 3.

The flow design of the weight placement as well as the loft angles of the clubs can be seen in FIGS. 1*a*–1*f*. It is noted that the weights 1 are depicted as being integral with the inner upper surfaces 5 of the club heads 3 and are substantially parallel to the club faces. The weights 1 should preferably be balanced along the center of mass of the unweighted club head which extends through the club face. In FIGS. 1*a*–1*c* the neck of the clubs is identified by reference numeral 6'.

Figure 2A:
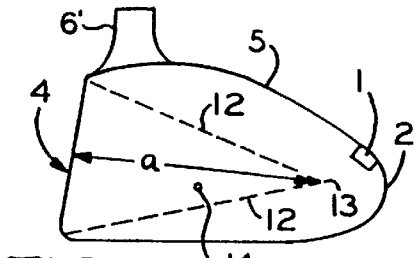
FIGS. 2*a*–2*j* depict the manner in which the mass of club heads are "focused" inwardly from the club faces using weights according to one embodiment of the present invention.
Figure 2B:
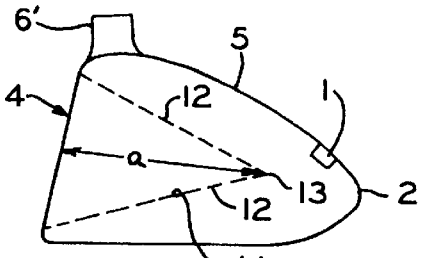
Figure 2C:
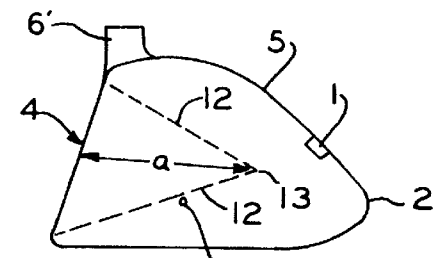
Figure 2D:
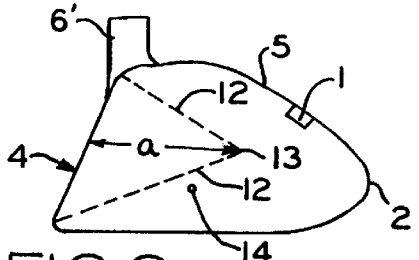
Figure 2E:
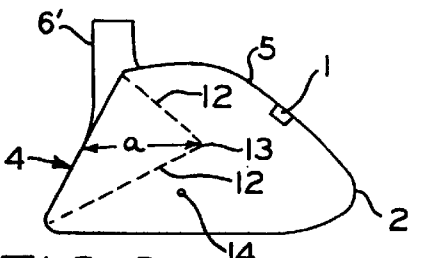
Figure 2F:
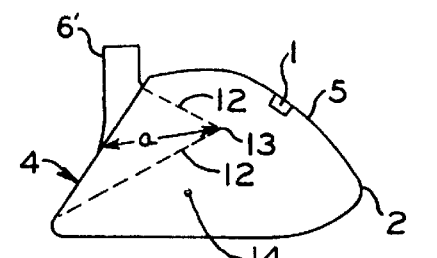
Figure 2G:
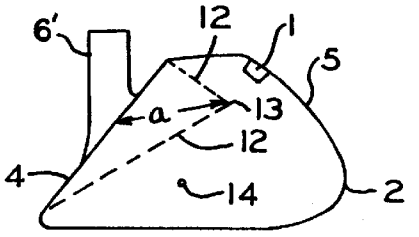
Figure 2H:
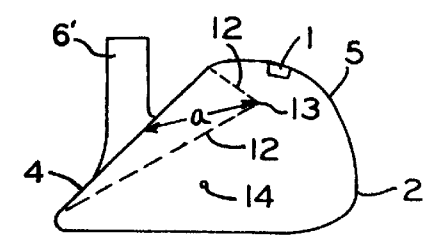
Figure 2I:
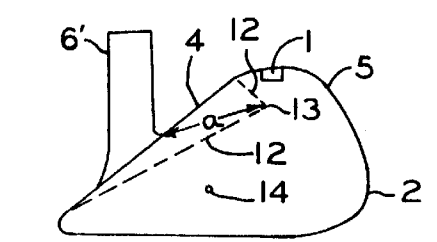
Figure 2J:
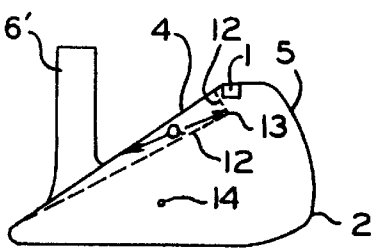

FIGS. 2*a*–2*j* depict the manner (not to scale) in which the mass of club heads are "focused" inwardly from the club faces using weights according to one embodiment of the present invention. FIG. 2*a* depicts a #1 wood in cross-section with a weight 1 positioned adjacent the upper surface 5 near the back 2 of the head. In FIG. 2*a* the manner in which weight 1 "focuses" the mass of the club head is indicated by phantom lines 12, which converge from the face 4 of the club head to a focal point 13. The depth of the focal point 13 to the center of the face 4 of the club head is indicated by the distance "a." Point 14 indicates the center of gravity of an unweighted club head which coincides with the focal point of mass or center of gravity for an unweighted club head.

FIGS. 2*b*–2*j* are similar top FIG. 2*a* and depict club heads which progressively increasing loft angles (#2–#10 respectively). The manner in which the position of the weights 1 focuses the mass of the club heads can be seen in FIGS. 2*a*–2*j*. Moreover the resulting focused area or volume of mass can be seen. The placement of the weights 1 in FIGS. 2*a*–2*j* is similar to the flow design depicted in FIGS. 1*a*–1*f*.

The positioning of the weights discussed above is between the back and front or face of a club head. According to another embodiment of the present invention, compensating or correctional weights can be positioned at or adjacent the face of a club between the bottom and top or upper side of the club face. In this embodiment, the weights provide an effect which occurs at the instance of impact between the club face and ball.

Figure 3:
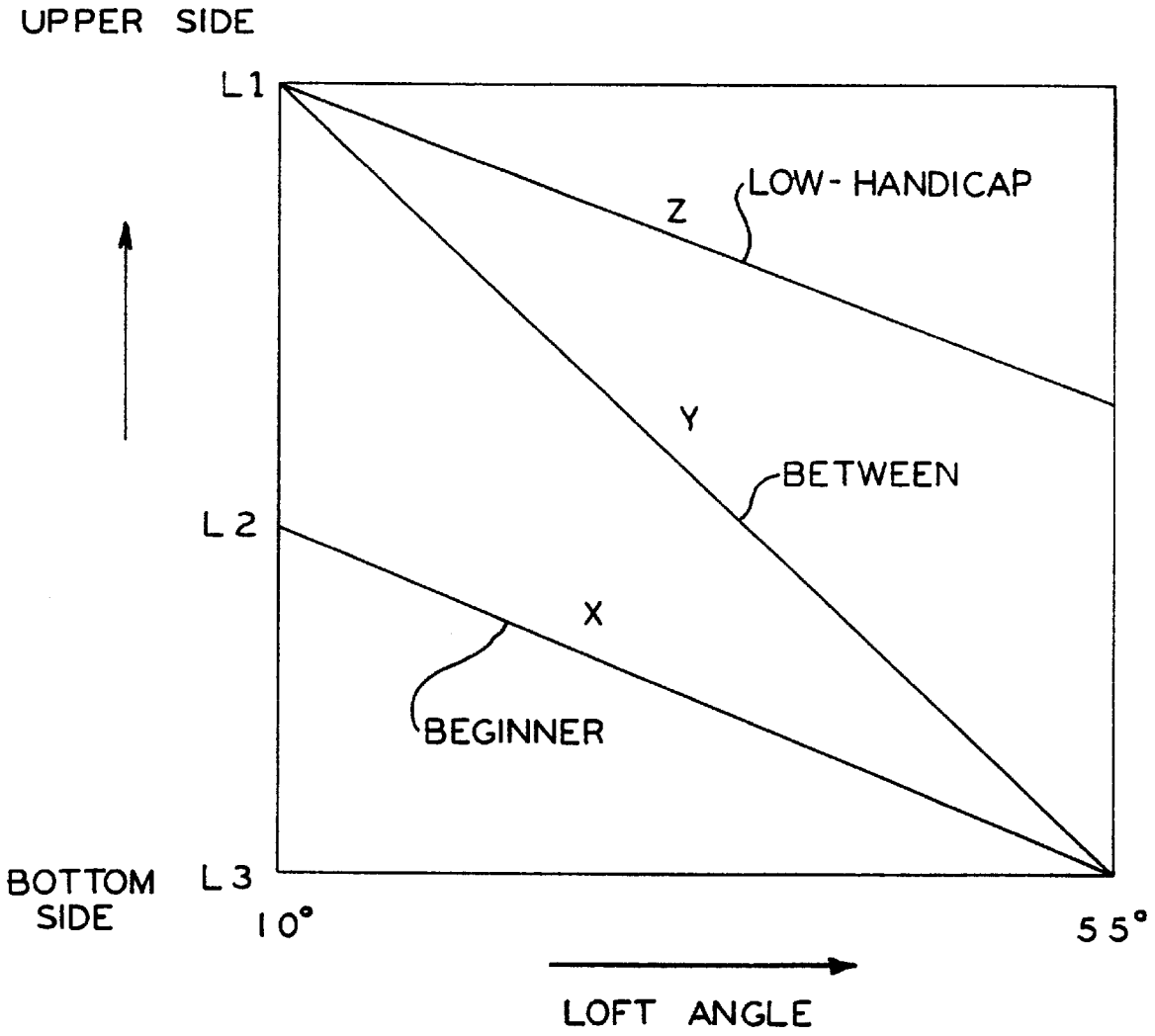
FIG. 3 is a graphical depiction of the relationship between the position of an added weight and swing speed of a golfer for various clubs according to another embodiment of the present invention.

FIG. 3 is a graphical depiction of the relationship between the position of weight and swing speed of a golfer for various clubs according to another embodiment of the present invention. In FIG. 3 line X represents the swing speed of a beginner or novice golfer, line Y represents the swing speed of an intermediate golfer, and line Z represents the swing speed of an experienced or professional golfer. The horizontal axis in FIG. 3 represents progressive golf club numbers (and loft angles). The vertical axis in FIG. 3 represents the location or position of compensating or correctional weights according to the present invention, between the bottom and top or upper side the club faces.

As can be seen in FIG. 3 the location or position of the compensating or correctional weights follows a particular flow design which is approximately linear for intermediate, beginner or novice, and professional golfers. As indicated, for a given loft angle or club number, the compensating or correctional weight should be positioned closer to the bottom of the club face for a beginner or novice golfer and closer to the top or upper side of the club face for experienced or professional golfers. As indicated by the slopes of lines X, Y, and Z, the change in position of the weights with respect to loft angle (or club number) is approximately the same for beginner or novice golfers and experienced or professional golfers. It is to be understood that the slope of lines which can be represented in FIG. 3 are functions of loft angle, weight location or position, and club swing speed. Therefore, although only representative lines are depicted for beginner or novice golfers, intermediate golfers, and experienced or professional golfers, other lines could be included to represent golfers with differing swing speeds.

Figure 4A:
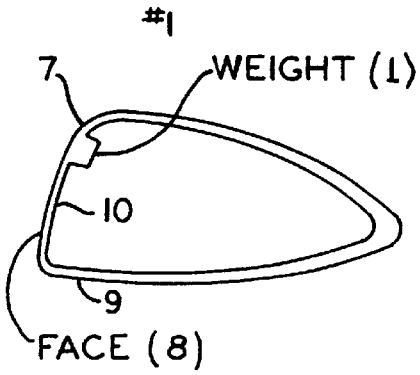
FIGS. 4*a*–4*f* depict the flow design of weight positioning for a set of golf clubs in cross-sectional and corresponding front views according to one embodiment of the present invention.
Figure 4D:
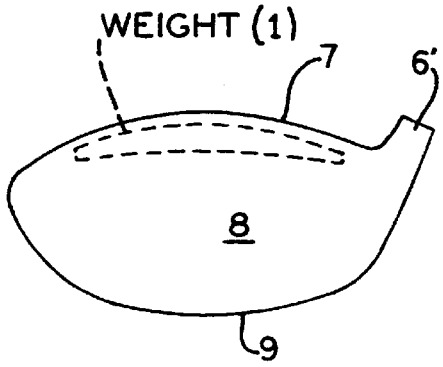
Figure 4B:
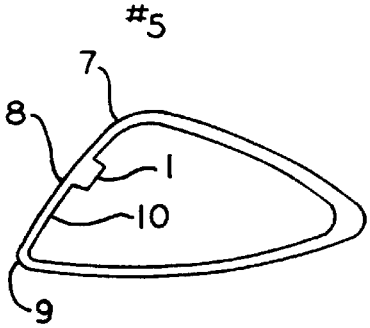
Figure 4E:
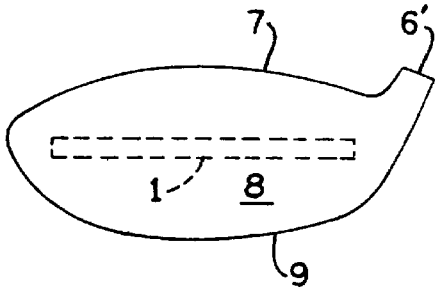
Figure 4C:
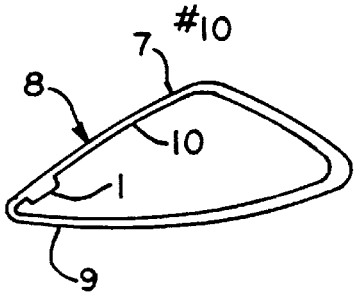
Figure 4F:
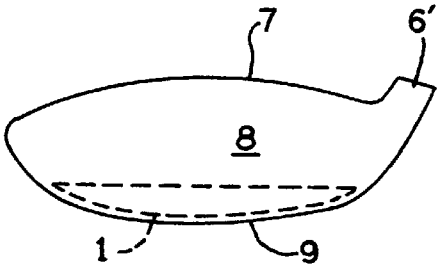

FIGS. 4*a*–4*f* depict the flow design of weight positioning for a set of golf clubs in top and corresponding cross-sectional views. FIGS. 4*a* and 4*d* correspond to a #1 wood or iron and depict how the weight 1 is positioned near the top or upper side 7 of the club face 8 in a manner which corresponds to the graphical relationship depicted in FIG. 3. FIGS. 4*b* and 4*e* correspond to a #5 wood or iron and depict how the weight 1 is positioned near the middle of the club face 8 in a manner which corresponds to the graphical relationship depicted in FIG. 3. FIGS. 4*c* and 4*f* correspond to a #10 wood or iron and depict how the weight 1 is positioned near the bottom 9 of the club face 8 in a manner which corresponds to the graphical relationship depicted in FIG. 3.

The flow design of the weight placement as well as the loft angles of the clubs can be seen in FIGS. 4*a*–4*f*. It is noted that the weights 1 are depicted as being integral with the inner front surfaces 10 of the club heads 3. This manner of incorporating the weights is suitable for woods. As depicted, the weights 1 are parallel to the club faces. The weights 1 should preferably be balanced along the center of mass of the unweighted club head which extends through the club face. In FIGS. 4*d*–4*f* the neck of the clubs is identified by reference numeral 6'.

Figure 5A:
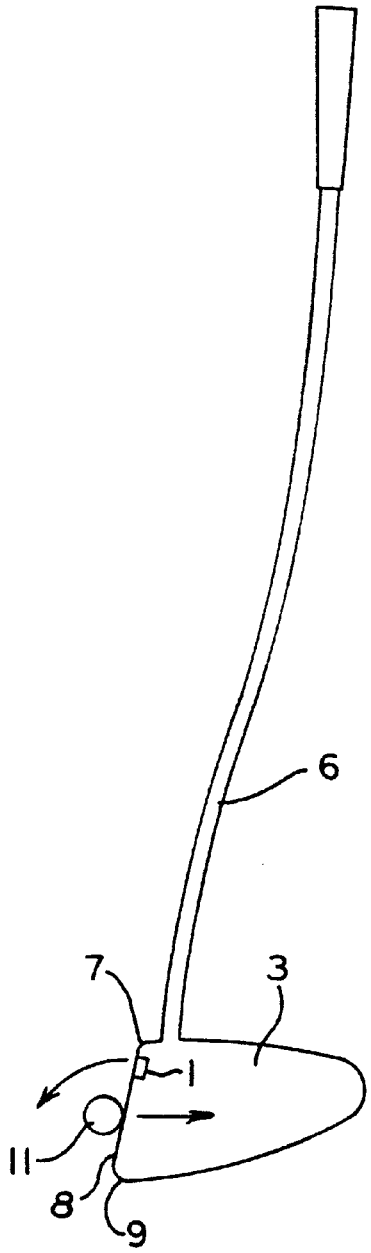
FIG. 5*a* is a diagram which depicts impact angles of less-lofted golf clubs which are weighted according to one embodiment of the present invention.

FIG. 5*a* is a diagram which depicts impact angles of less-lofted golf clubs. FIG. 5*a* depicts a less-lofted club such as a #1 wood or iron. In this embodiment of the invention, the position of weight 1 at or adjacent the club face 8 determines the effect provided by the weight. As depicted, for less-lofted clubs, the weight 1 is near the top or upper side 7 of the club face 8, so that at the instant of impact with the ball 11, the force created by the weight 1 tends to turn the club head 3 forward. This turning of the club head 3 decreases loft angle and thus, decreases the backspin which is imparted to the ball 11. Moreover, the almost instantaneous pivoting of the club face 8 as it contacts the ball tends to reduce or counteract the backspin which is imparted by the loft angle of the club face 8. According to the present invention, the position of the weight 1 is selected so that backspin is optimized for the maximum distance. In addition, rotation of the club face 8 helps prevent the ball 11 from going too high in the air. The combined result is that the ball 11 rolls too much when it hits and lands on the ground.

Figure 5B:
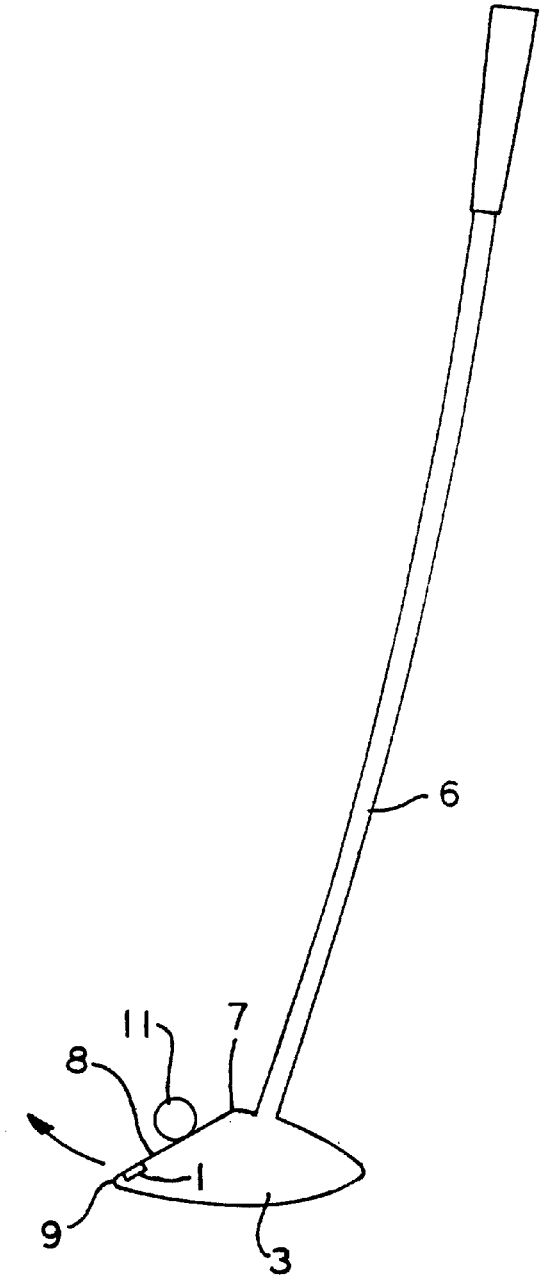
FIG. 5*b* is a diagram which depicts impact angles of more-lofted golf clubs which are weighted according to one embodiment of the present invention.

FIG. 5*b* is a diagram which depicts impact angles of more-lofted golf clubs. FIG. 5*a* depicts a more-lofted club such as a #10 wood or iron. As depicted, for more-lofted clubs, the weight 1 is nearer the bottom 9 of the club face 8, so that at the instant of impact with the ball 1, the force created by the weight 1 tends to turn the club head 3 backward. This turning of the club head 3 increases loft angle and thus, increases the backspin which is imparted to the ball 11. In practice, the loft of the club head 3 is actually maintained square at the instance of impact. This is because, absent a compensating or correctional weight 1 at the face 8 of the club head 3 according to the present invention, the club head 3 would tend to turn forward. When a compensating or correctional weight 1 is provided according to the present invention, the club head 3 is prevented from turning forward. As a result, the club face 8 is maintained square until just after the impact. Consequently, the distance and direction the ball 11 travels is stable. Since the club head 3 of a more-lofted clubs are designed to have greater loft angles, a large amount of backspin is imparted to the ball 11 as the ball 11 goes up higher in the air. On the green, the ball 11 stops just after landing and does not roll much, because of the backspin.

In addition to maintaining the club face square, the almost instantaneous pivoting of the club face 8 as it contacts the ball 11 tends to increase backspin which is imparted by the loft angle of the club face 8.

It can be understood from FIGS. 5*a* and 5*b* how the weight position is used according to the present invention to control the effective loft angle of the club face at the instance of impact and affect backspin. In this regard, the positioning of the weights between the bottom and top or upper side of the club faces provide moment arms between the centers of mass of the weights and the point of impact with the balls. The force created by the weight and the speed of the club swing acts on these moment arms to control the effective loft angle of the club face at the instance of impact and affect backspin. It is to be understood that while FIGS. 5*a* and 5*b* depict #1 and #10 woods or irons, intermediate clubs will follow a flow design as indicated in FIGS. 4*a*–4*f*.

Figure 6A:
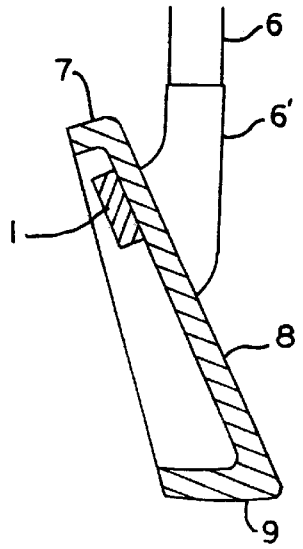
FIGS. 6*a*–6*c* depict how compensating or correctional weights can be used in conjunction with iron club sets according to the present invention.
Figure 6B:
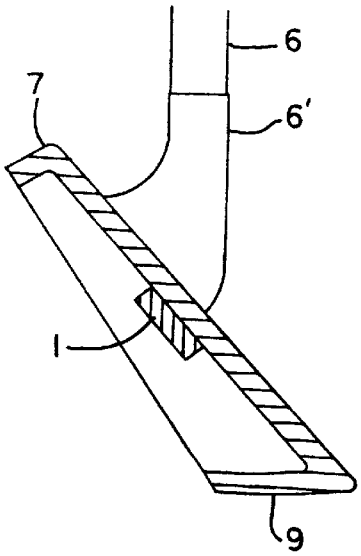
Figure 6C:
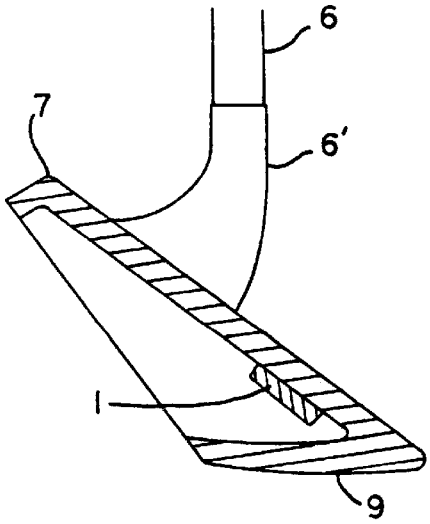

FIGS. 6*a*–6*c* depict how compensating or correctional weights can be used in conjunction with iron 20 club sets. FIG. 6*a* depicts the position of a weight 1 at the club face 8, near the top or upper side 7 of an iron. FIG. 6*b* depicts the position of a weight 1 at the club face 8, near the middle of the club face 8. FIG. 6*c* depicts the position of a weight at the club face near the bottom of an iron. These positions correspond to $L_1$, $L_2$, and $L_3$ which are identified in FIG. 3 for an intermediate golfer using a club with a 10° loft angle (a less-lofted club), a club with an intermediate loft angle (and length), a club with a 55° loft angle (more-lofted club).

According to a further embodiment of the present invention the embodiments depicted in FIGS. 1–2 and 3–5 can be combined. The result of this combination is clubs and club sets which have compensating or correctional weights provided both between the back and front or face of the club head (as depicted in FIGS. 1–2) and between the bottom and the top or upper side of the club face (as depicted in FIGS. 3–5). As can be understood from the above description, this combination of embodiments provides two compensating or correctional weights which focus the mass of a club head and define a moment arm as discussed above. The compensating or correctional weight provided between the back and front or face of the club focuses the mass of the club head so as to improve striking force or power imparted to a ball. The compensating or correctional weight which provided between the bottom and the top of upper side of the club face provides a moment arm which is effective or active at the instance of impact with the ball to increase or maintain the effective loft angle of the club face.

Figure 7A:
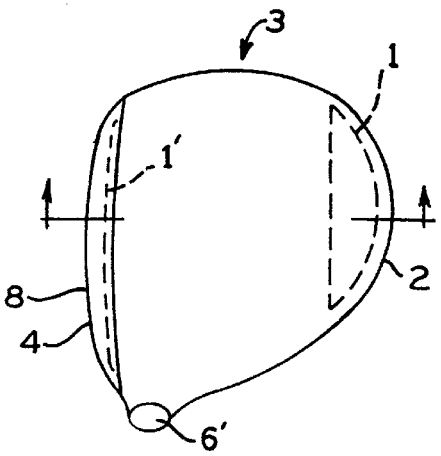
FIGS. 7*a*–7*f* depict the flow design of weight positioning for a set of golf clubs in perspective top and corresponding cross-sectional views according to one embodiment of the present invention.
Figure 7D:
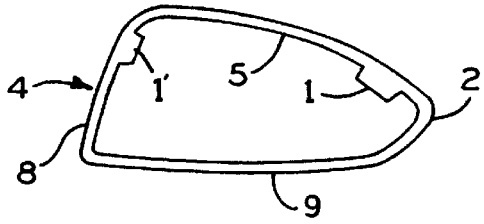
Figure 7B:
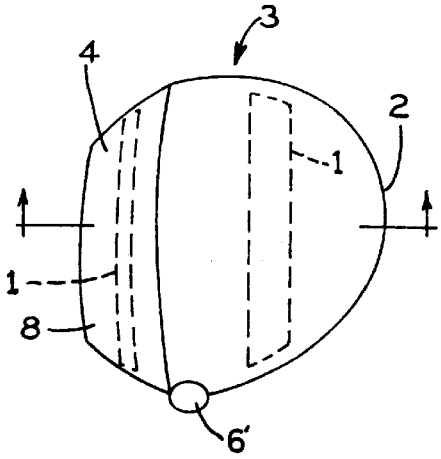
Figure 7E:
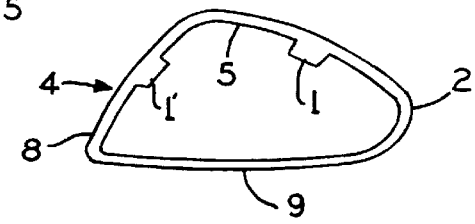
Figure 7C:
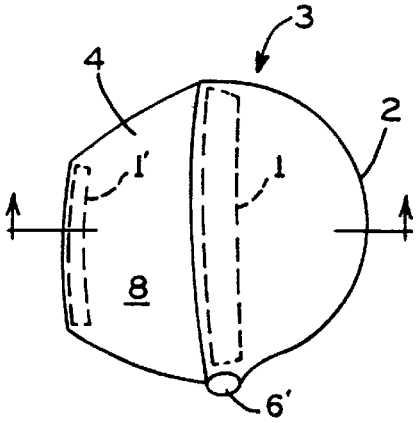
Figure 7F:
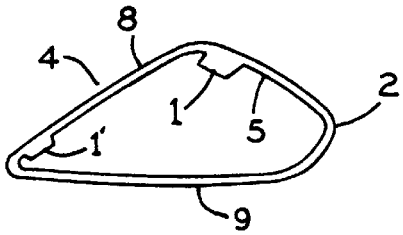

FIGS. 7*a*–7*f* depict the flow design of weight positioning for a set of golf clubs in perspective top and corresponding cross-sectional views according to one embodiment of the present invention. FIGS. 7*a* and 7*d* correspond to a #1 wood and depict how one weight 1 is positioned near the back 2 of the club head 3, and how another weight 1' is positioned near the top or upper side surface 7 of the club face 8 in a manner which corresponds to the graphical relationship depicted in FIG. 3. FIGS. 7*b* and 7*e* correspond to a #5 wood and depict how one weight 1 is positioned near the middle of the club head 3, and how another weight 1' is positioned near the middle of the club face 8 in a manner which corresponds to the graphical relationship depicted in FIG. 3. FIGS. 7*c* and 7*f* correspond to a #10 wood and depict how one weight 1 is positioned near the front 4 of the club head 3, and how another weight 1' is positioned near the bottom 9 of the club face 8 in a manner which corresponds to the graphical relationship depicted in FIG. 3.

The flow design of the weight placement as well as the loft angles of the clubs can be seen in FIGS. 7*a*–7*f*. It is noted that the weights 1 are depicted as being integral with the inner upper surfaces 5 of the club heads 3 and are substantially parallel to the club faces. The weights 1 should preferably be balanced along the center of mass of the unweighted club head which extends through the club face. In FIGS. 7*a*–7*c* the neck of the clubs is identified by reference numeral 6'.

Figure 8:
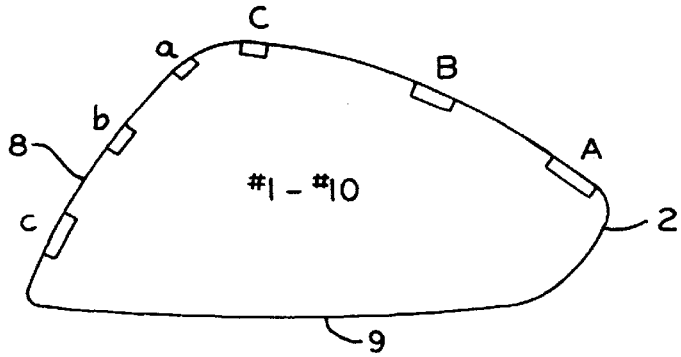
FIG. 8 depicts positions for various weights that can be used in combination according to one embodiment of the present invention.

FIG. 8 depicts positions for various weights that can be used in combination according to one embodiment of the present invention. As an example of the masses of weights which can be used according to the present invention, the follow Table 1 lists suitable weights by mass:

TABLE 1

| Position | Mass in Grams |
|---|---|
| a | 5 to 10 |
| b | 7.5 to 20 |

TABLE 1-continued

| Position | Mass in Grams |
|---|---|
| c | 10 to 30 |
| A | 10 to 30 |
| B | 7.5 to 20 |
| C | 5 to 10 |

As a more concrete example, the total weight of a #1 wood would be about 210 g, including a 5g weight at position "a" and a 10 g weight at position "A." The total weight of a #10 wood would be about 255 g, including a 12 g weight at "c" and a 6 g weight at "C." The weights and clubs according to the present invention can be made from stainless steel or any conventional material.

The heights of the club faces can increase the effect of the weights according to the present invention by increasing the moment arms at which the weights are position. This effect is particularly associated with weights that are positioned adjacent the face of the club heads.

Figure 9:
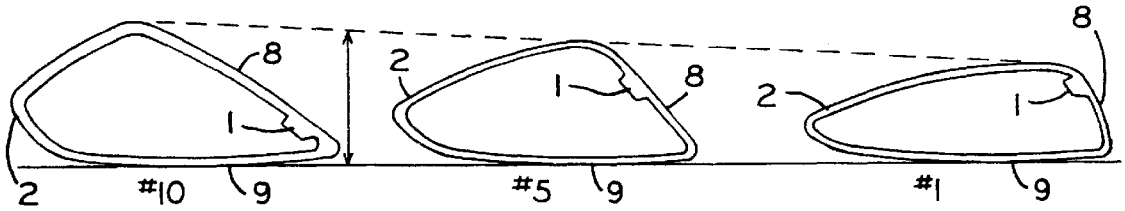
FIG. 9 depicts the differences in heights for a set of woods according to one embodiment of the present invention.

FIG. 9 depicts the differences in heights for a set of woods according to one embodiment of the present invention. Table 2 lists the heights and widths (in mm) of the club faces depicted in FIG. 9

TABLE 2

| Club # | 1 | 2 | 3 | 4 | 5 | 6 | 7 | 8 | 9 | 10 |
|---|---|---|---|---|---|---|---|---|---|---|
| Loft ∠ | 11 | 15 | 20 | 25 | 30 | 35 | 40 | 45 | 50 | 55 |
| Height | 42.5 | 43.0 | 44.0 | 44.0 | 44.5 | 44.5 | 44.7 | 44.8 | 44.9 | 45.0 |
| Width | 95 | 93 | 92 | 91 | 91 | 90 | 90 | 89 | 89 | 89 |

Figure 10:
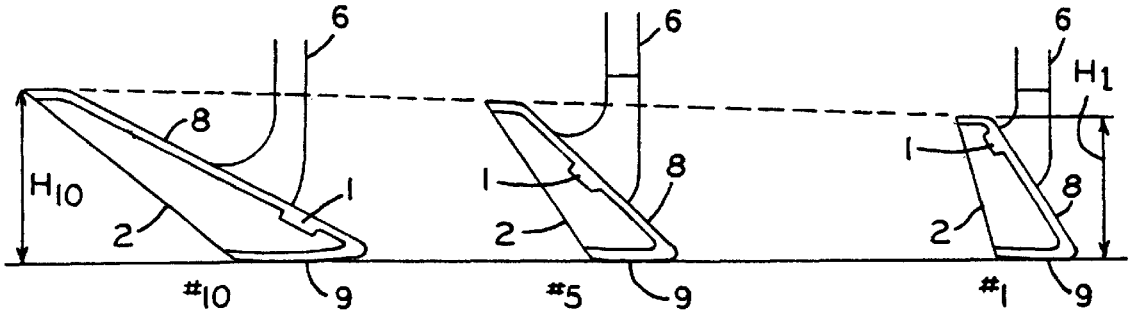
FIG. 10 depicts the differences in heights for a set of irons according to one embodiment of the present invention.

FIG. 10 depicts the differences in heights for a set of irons according to one embodiment of the present invention, where the height of a #10 iron ($H_{10}$) is greater than the height of a #1 iron ($H_1$).

Although the present invention has been described with reference to particular means, materials and embodiments, from the foregoing description, one skilled in the art can easily ascertain the essential characteristics of the present invention and various changes and modifications may be made to adapt the various uses and characteristics without departing from the spirit and scope of the present invention as described by the claims which follow.

What is claimed is:

1. A golf club set comprising:

a plurality of progressively numbered golf clubs, each of which includes a head having a face, a bottom, a top which extends between the face and the bottom, and opposed sides, the faces of the heads having progressively increasing loft angles which correspond to the progressive numbers of the clubs, each of the clubs including an elongated weighted structure projecting inwardly from an inner surface of the head and located adjacent the face thereof between the bottom and top and positioned nearer the top than the bottom for smaller club numbers and nearer the top for larger club numbers, each of the heads of the clubs further includes another elongate weighted structure projecting inwardly from the inner surface of the head and located adjacent the top thereof between the face and the bottom and positioned nearer the bottom for smaller club numbers and nearer the face for larger club numbers.

2. A golf club set according to claim 1, wherein the clubs comprise woods.

3. A golf club set comprising:

a plurality of progressively numbered golf clubs, each of which includes a head having a face, a bottom, a top which extends between the face and the bottom, and opposed sides, the faces of the heads having progressively increasing loft angles which correspond to the progressive numbers of the clubs, each of the heads of the clubs including an elongate weighted structure projecting inwardly from an inner surface of the head and located adjacent the top thereof between the face and the bottom and positioned nearer the bottom for smaller club numbers and nearer the face for larger club numbers.

4. A golf club set according to claim 3, wherein each of the heads further includes another elongate weighted structure projecting inwardly from the inner surface of the head and located adjacent the face thereof between the bottom and top and positioned nearer the top for smaller club numbers and nearer the bottom for larger club numbers.

5. A golf club set according to claim 4, wherein the face of the head includes a loft angle, and wherein as the face is provided with a greater loft angle, the weighted structure adjacent the top is positioned closer to the face and the weighted structure adjacent the face is positioned closer to the bottom.

6. A golf club set according to claim 4, wherein the mass of the weighted structure adjacent the top is decreased as the weighted structure is positioned closer to the face and the mass of the weighted structure adjacent the face is increased as the weighted structure is positioned closer to the bottom.

7. A golf club comprising:

a head having a face, a bottom, a top which extends between the face and the bottom, and opposed sides, the face of the head including a loft angle of not more than 20 degrees;

an elongate weighted structure projecting inwardly from an inner surface of the head and provided adjacent the top which provides a focal change in the mass of the head from an unweighted focal position; and another elongate weighted structure projecting inwardly from an inner surface of the head and provided adjacent the face which provides a moment of inertia when the face strikes a ball, the mass of the weighted structure adjacent the top is less than the mass of the weighted structure adjacent the face, and the weighted structure adjacent the top is positioned closer to the bottom and the weighted structure adjacent the face is positioned closer to the top.

8. A golf club comprising:

a head having a face, a bottom, a top which extends between the face and the bottom, and opposed sides, the face of the club including a loft angle of not less than 50 degrees;

an elongate weighted structure projecting inwardly from an inner surface of the head and provided adjacent the top which provides a focal change in the mass of the head from an unweighted focal position; and another elongate weighted structure projecting inwardly from an inner surface of the head and provided adjacent the face which provides a moment of inertia when the face strikes a ball, the mass of the weighted structure adjacent the top is larger than the mass of the weighted structure adjacent the face and the weighted structure adjacent the top is positioned closer to the face and the weighted structure adjacent the face is positioned closer to the bottom.

9. A golf club comprising:

a shaft;

a head having a mass, a face, a bottom, a top which extends between the face and the bottom, the face of the head including a loft angle of not more than 20 degrees; and a single elongate weighted structure projecting inwardly from an inner surface of the head and located adjacent the top of the head between and apart from the face and the bottom thereof and positioned so as to change a focus of the mass from an unweighted focal point, the weighted structure being positioned closer to the bottom than the face.

* * * * *